US008770428B2

(12) United States Patent
Brauer

(10) Patent No.: US 8,770,428 B2
(45) Date of Patent: Jul. 8, 2014

(54) LID FOR CLOSING AN OPENING OF A CONTAINER, PACKAGING INCLUDING A CONTAINER WITH SUCH A LID AND PROCESS FOR SEALING A CONTAINER WITH SUCH A LID

(75) Inventor: Jens Brauer, Leer (DE)

(73) Assignee: Weener Plastik GmbH, Weener (DE)

( * ) Notice: Subject to any disclaimer, the term of this patent is extended or adjusted under 35 U.S.C. 154(b) by 895 days.

(21) Appl. No.: 12/782,815

(22) Filed: May 19, 2010

(65) Prior Publication Data

US 2011/0120998 A1 May 26, 2011

Related U.S. Application Data

(60) Provisional application No. 61/179,469, filed on May 19, 2009.

(51) Int. Cl.

| | |
|---|---|
| ***B65D 51/20*** | (2006.01) |
| ***B65B 7/01*** | (2006.01) |
| ***B65B 7/28*** | (2006.01) |

(52) U.S. Cl.

CPC . *B65D 51/20* (2013.01); *B65B 7/01* (2013.01); *B65D 2251/0093* (2013.01); *B65D 2251/0015* (2013.01); *B65B 7/2835* (2013.01); *B65B 7/2878* (2013.01)

USPC ..... 220/359.3; 220/265; 220/359.1; 215/232; 215/45

(58) Field of Classification Search

USPC ..... 220/214, 359.1, 359.4, 265; 215/341, 215/347, 349, 350, 45

See application file for complete search history.

(56) References Cited

U.S. PATENT DOCUMENTS

| | | | |
|---|---|---|---|
| 1,543,097 | A | 6/1925 | Canton |
| 2,251,392 | A | 8/1941 | Bernhardt |
| 2,751,130 | A | 8/1951 | Murphy |
| 2,652,177 | A | 9/1953 | Lagemann |
| 3,146,913 | A | 9/1964 | Nagai |
| 3,174,661 | A | 3/1965 | Speicher |

(Continued)

FOREIGN PATENT DOCUMENTS

| | | |
|---|---|---|
| AU | B-57653/90 | 1/1991 |
| DE | 40 20 371 C1 | 6/1990 |

(Continued)

OTHER PUBLICATIONS

European Search Report for European Patent Application No. 09015896.5, "Lid for closing a container opening, packaging with a container and such a lid and method for sealing a container with such a lid", dated Apr. 5, 2012, with English translation.

*Primary Examiner* — Robert J Hicks
*Assistant Examiner* — Kareen Rush
(74) *Attorney, Agent, or Firm* — Hamilton, Brook, Smith & Reynolds, P.C.

(57) ABSTRACT

A lid (16) for closing an opening (12) of a container (10) comprises a sealing foil (26) which is sealable to a fringe (14) of the container opening (12) and the sealing foil (26) is formed tearable and/or is attachable tearable to the fringe (14) of the container opening (12). Therefore, the sealing foil (26) is fixed directly at the lid (16) and the fixing connection (28) is formed between the sealing foil (26) and the lid (16) more weakly than the intended sealing connection (34) between the sealing foil (26) and the fringe (14) of the container opening (12).

13 Claims, 7 Drawing Sheets

(56) References Cited

U.S. PATENT DOCUMENTS

| | | | | |
|---|---|---|---|---|
| 5,054,634 | A | 10/1991 | Margotteau | |
| 5,176,271 | A * | 1/1993 | Painchaud et al. | 215/261 |
| 5,915,577 | A * | 6/1999 | Levine | 215/232 |
| 5,975,369 | A | 11/1999 | Yurkewicz et al. | |
| 6,112,953 | A | 9/2000 | Gueret | |
| 6,299,036 | B1 | 10/2001 | Fuchs | |
| 6,439,442 | B1 | 8/2002 | Markert et al. | |
| 7,066,360 | B2 | 6/2006 | Hearld et al. | |
| 7,766,178 | B2 * | 8/2010 | Robinson et al. | 215/349 |
| 8,113,367 | B2 * | 2/2012 | Pawlick et al. | 215/263 |
| 8,251,236 | B1 * | 8/2012 | Robinson et al. | 215/350 |
| 2006/0054584 | A1 * | 3/2006 | Jackman | 215/347 |
| 2009/0008392 | A1 * | 1/2009 | de Cleir | 220/359.4 |
| 2011/0132926 | A1 | 6/2011 | Feierabend et al. | |

FOREIGN PATENT DOCUMENTS

| | | | |
|---|---|---|---|
| DE | 19651996 | A1 | 6/1998 |
| DE | 19951331 | A1 | 4/2000 |
| FR | 1445018 | | 5/1966 |
| GB | 2 123 392 | A | 2/1984 |

* cited by examiner

LID FOR CLOSING AN OPENING OF A CONTAINER, PACKAGING INCLUDING A CONTAINER WITH SUCH A LID AND PROCESS FOR SEALING A CONTAINER WITH SUCH A LID

RELATED APPLICATION

This application claims the benefit of U.S. Provisional Application No. 61/179,469, filed on May 19, 2009. The entire teachings of the above application are incorporated herein by reference.

The invention refers to a lid for closing an opening of a container, a packaging with a container and such a lid as well as a process for sealing of a container with such a lid.

Packagings of consumer goods, for example such as food, cosmetics, pharmaceuticals and the like will often be provided with a sealing foil. This sealing foil serves as a tamper-proof closure which can be opened only once or can not be opened without its destruction. So an unnoticed closing is impossible after a preceding opening of this closure. Depending to the embodiment of the sealing foil it also serves as a barrier layer to preserve the condition or the aroma of the respective consumer goods in the packaging still sealed, for example.

The sealing of the packaging is usually achieved by one of two known processes. For example, the sealing foil is glued or welded directly on the fringe of a container opening by application of pressure and heat, before the lid is put on the container opening. According to another method, the sealing foil is first arranged in the lid and is then pressed against the fringe of the container opening while the lid is put on the container opening, before gluing or welding the sealing foil to the fringe of the container opening inductively, for example. The latter inductive sealing has the advantage that it can be done with very short time intervals for sealing in the filling line of the production.

Containers sealed with sealing foils of this kind are described by the publications DE 39 20 324 A1 and DE 91 08 868 U1, for example, which deal with the problems of tearing the sealing foil open to open the container, especially. Concerning the arrangement of the sealing foil in the lid and the following attachment of the lid on the container opening and sealing of the sealing foil on the fringe of the container opening it has been common practice to first laminate the sealing foil on a carrier disk, usually from a foamed material or from cardboard packaging, and then to insert this composite material in the lid. This process is known from DE 40 20 371 C1, for example. By opening of the packaging by the consumer for the first time, this connection between the carrier disk and the sealing foil breaks while the sealing connection between the sealing foil and the fringe of the container opening is still maintained. The consumer realises this process of breaking the bond between carrier disk and sealing foil by a raised effort when opening for the first time and the noises associated with it.

In particular, the carrier disk of the sealing foil is used to simplify the handling of the sealing foil during the production process and the filling process and sealing process. The carrier disk causes a stiff composite which decreases the danger of falling off from the lid (e.g., by reason of air nozzles in the production lines) and a damage. Nevertheless, a disadvantage of these carrier disks exists that these carrier disks remain in the lid after separating the sealing foil. This causes an additional expenditure when recycling the lid, for example, which is usually made of a material different from that of the carrier disk, because the carrier disk must be separated from the remainder of the lid by an additional laborious step. Moreover, the carrier disk forms an additional component which causes additional production costs and warehouse charges, correspondingly.

Therefore, the task of the present invention is to create an improved sealing technique for containers which deals without a carrier disk for the sealing foil.

According to the first aspect of the invention, the task is solved by a lid for closing an opening of a container which is provided with a sealing foil. The sealing foil is sealable to a fringe of the container opening. The sealing foil is formed to be torn open and/or to be attached on the fringe of the container opening to be torn off. The sealing foil is characterized in that it is fixed directly to the lid and the fixing connection between the sealing foil and the lid is formed weaker than the intended sealing connection between the sealing foil and the fringe of the container opening. According to the invention, the sealing foil is not arranged in the lid with the help of a carrier disk, but is fixed directly at the lid. By this measure, a carrier disk or the like for the sealing foil is omitted as an additional component. In doing so, effort and costs in production are reduced, as well as warehousing and recycling of the lid. The fixing connection between the sealing foil and the lid is formed weaker than the intended sealing connection between the sealing foil and the fringe of the container opening. So the consumer's impression when opening the container for the first time is similar to the conventional system with the sealing foil concealed on a carrier disk in the lid. In doing so it is ensured that the sealing foil is separated from the lid when removing the lid from the container opening for the first time, but the sealing connection is maintained between the sealing foil and the fringe of the container opening. The user realises the process of loosening the sealing foil off the lid by a raised effort as well as by the noises connected therewith.

The present invention includes basically all types of containers of arbitrary forms and sizes, made from arbitrary materials (glass, plastic, metal, etc.) and with arbitrary forms, sizes and arrangements of container openings. The containers may hold various objects or substances, for example food, pharmaceuticals, cosmetics, etc. The present invention also includes basically all sorts of lids of arbitrary forms and sizes, made from arbitrary materials (glass, plastic, metal, etc.) and with various locking mechanisms (screw cap, spring seal, cuff sealing, etc.). The lid has to be adapted to the respective opening of the container to be sealed, of course. Besides, containers and lids can be manufactured from the same or from different materials. Moreover, the lid may be designed to seal the container repeatedly or only once, alternatively.

The term "sealing foil" encloses coated single-layer foil constructions, multi-layer foil constructions as well as foil constructions made from one or from several materials. The properties of the sealing foil may be devised freely with respect to their compatibility with the substances to be held in the container and their desired barrier layer effect (e.g., vapour lockout, oxygen lockout, fluidtight, gasproof, condensation-preventing, etc.). Further, the "sealing foil" can be a sealing foil with or without pull tab for simpler opening of the sealing of the container.

The term "fixing connection" between the sealing foil and the lid encloses all sorts of detachable connections within the scope of the present invention. The fixing connection is achieved in particular by force-fit connections and/or integral connections wherein adhesive bonded connections like welded bonds or adhesive bonds are preferred, especially.

The term "sealing connection" between the sealing foil and the fringe of the container opening includes basically all sorts of detachable and undetachable connections within the scope of the present invention. These connections form a bond with properties of fluid-tightness adapted to the application purpose of the packaging. The sealing connection is achieved preferably by integral connections like welded bonds or adhesive bonds. Besides, the sealing connection can be produced, for example, by heat and/or pressure as well as inductively or by heat radiation and/or heat conduction.

Preferably the sealing foil comprises a metal layer the metal of which is an aluminium alloy or contains aluminium.

More preferably the sealing foil is a metal foil which contains aluminium, in particular, and which is provided with a layer of plastic on both sides for the inductive fixation of the foil.

According to the invention, the sealing foil can be fixed at the lid, for example with its side surface facing away from the container opening and/or with its radial circumferential surface.

Besides, the sealing foil can be fixed alternatively at the lid in essentially holohedral manner or can be fixed at the lid only sectionally. In the latter case the sealing foil can be fixed at the lid through one or several connecting points, strips and/or surfaces, for example.

In a preferred embodiment of the invention, the lid can comprise a bridge which presses the sealing foil against the fringe of the container opening when the lid closes the container opening. The sealing connection between the sealing foil and the fringe of the container opening can be improved or strengthened by the contact pressure of the sealing foil against the fringe of the container opening with the help of the bridge.

Thereby, the bridge at the lid can essentially correspond to the fringe of the container opening with regard to form and size in radial direction of the lid. So the contact pressure of the sealing foil against the fringe of the container opening can be imposed essentially evenly over the whole fringe connection surface.

In an other arrangement of the invention the sealing foil can be fixed at this bridge of the lid.

According to the second aspect of the invention, the above task is solved by a packaging with a container with an opening; a lid for sealing the container opening; and a sealing foil which is sealed to a fringe of the container opening, wherein the sealing foil is formed to be torn open and/or may be attached to the fringe of the container opening to be torn off, characterized in, that the sealing foil is fixed directly at the lid, wherein the fixing connection between the sealing foil and the lid is weaker than the sealing connection between the sealing foil and the fringe of the container opening, so that the sealing foil is separated from the lid at least when removing the lid from the container opening for the first time, but the sealing connection is maintained between the sealing foil and the fringe of the container opening.

The differences in the fixing connection can be caused by providing a metal foil with layers of plastic on both sides wherein the layers of plastic comprise different compositions and/or thickness.

The advantages and terminologies of this packaging of the invention correspond to those of the lid explained above according to the first aspect of the invention.

As an advantageous embodiment, the lid and the sealing foil for this packaging are formed or arranged in the manner described above.

According to the third aspect of the invention, the above mentioned task is solved by a process for sealing of a container with an opening which is sealable by a lid with the steps: Providing a lid; fixing a sealing foil directly at the lid; closing the container opening with the lid; and sealing of the sealing foil to a fringe of the container opening, wherein the fixing connection between the sealing foil and the lid is weaker than the sealing connection between the sealing foil and the fringe of the container opening.

The advantages and terminologies of this process according to this invention correspond to those of the lid explained above according to the first aspect of the invention.

In an embodiment of the invention, the sealing foil can be pressed against the fringe of the container opening while closing the container opening with the lid. In this manner, the sealing connection can be improved or strengthened between the sealing foil and the fringe of the container opening.

In advantageous embodiment, the lid and the sealing foil for this process are formed or arranged in the manner described above.

BRIEF DESCRIPTION OF THE DRAWINGS

The features mentioned above as well as further features, advantages and application possibilities of the invention become clearer from the following description with reference to the attached drawings.

DETAILED DESCRIPTION OF THE INVENTION

Figure 1A:
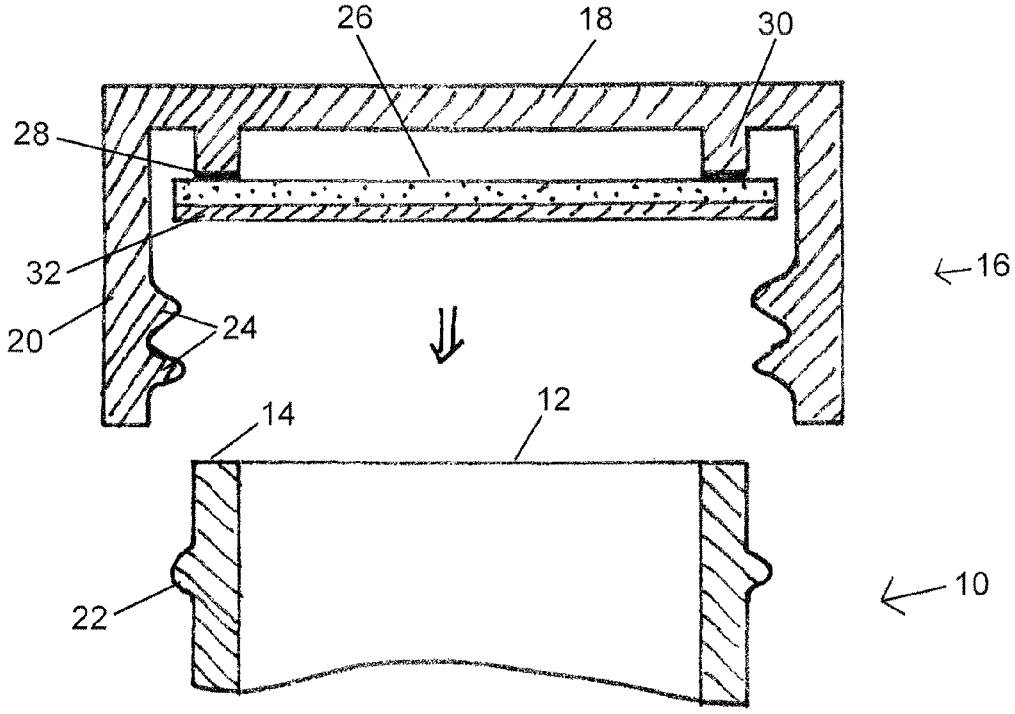
FIG. 1A shows a schematic sectional view of an packaging according to the first embodiment of the invention, before sealing the container opening with the lid.
Figure 1B:
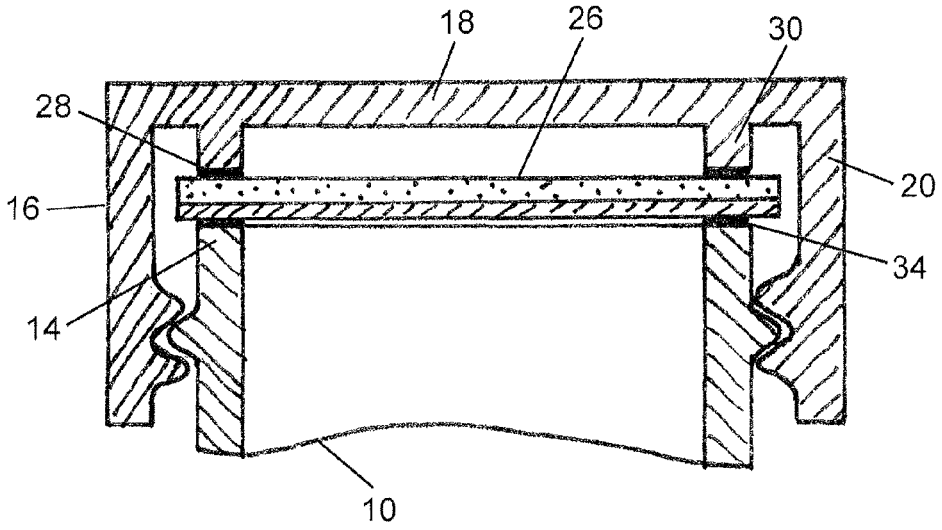
FIG. 1B shows a schematic sectional view of the packaging according to the first embodiment of the invention, on sealing the container.

Referring to FIGS. 1A and 1B a first embodiment of a packaging according to the present invention is described in further detail.

The packaging includes a container 10, for example, in the form of a glass with an opening 12 which is limited by a fringe 14. On the one hand the container opening 12 serves for filling the container 10 with food, for example, and for removing the food from the container 10, on the other hand.

The container opening 12 is closable by a lid 16 made of plastic, for example. The lid 16 is formed integrally, preferably, and comprises a discoidal closing disk 18 and a fringe section 20 projecting from the radial perimeter of this closing disk 18 in the direction towards the container 10. The inside diameter of this fringe section 20 is of larger dimension than the external diameter of the wall of the container which forms the opening fringe 14. So the lid 16 can be put on the container 10 while its fringe section 20 encompasses the container wall of the opening 12.

As illustrated in FIGS. 1A and 1B, the container wall forming the opening fringe 14 is formed with an outside thread 22. The fringe section 20 of the lid 16 is formed with an internal thread 24 which can be meshed with the outside thread 22 of the container opening 12. Therefore, the lid 16 of the present embodiment may be screwed to the container 10. However, the present invention shall not be limited neither to the thread shown in FIGS. 1A and 1B nor to a screwable lid per se.

A sealing foil 26 is arranged inside the lid 16, more specifically at the side of the closing disk 18 facing the container 10. This sealing foil 26 is fixed directly to the lid 16 through a welded bond or adhesive bond 28. As shown in FIGS. 1A and 1B, the lid 16 is further provided with an essentially ring-shaped bridge 30, for example, at the side of its closing disk 18 facing the container 10. The side of the sealing foil 26 facing away from the container 10 is fixed at this bridge 30. This fixing connection 28 between the sealing foil 26 and the bridge 30 of the lid 16 can be established essentially within the whole area of the bridge or only sectionally (e.g., glue dots), alternatively.

As shown in FIG. 1B, in particular, the sealing foil 26 is pressed against the fringe 14 of the container opening 12 by the bridge 30 of the lid 16 when the lid 16 is screwed on the container 10, entirely. In this condition, a sealing connection 34 is established between the sealing foil 26 and the fringe 14 of the container opening 12. This sealing connection 34 is established, for example, as a welded bond or adhesive bond, preferably inductively. For the inductive sealing connection 34, the sealing foil 26 which is preferably made from metal 26 comprises a layer of plastic 32 or the like, at least in the region of the fringe 14 of the container opening 12 but preferably holohedral. However, the heat required for establishing the sealing connection 34 can be also supplied in other manner, for example, through a direct contact with a heating element or by means of a hot airflow.

The sealing foil 26 may be torn open without effort, preferably without any tools on account of its small thickness of material and/or a suitable properties of material. In addition or alternatively, the sealing foil 26 may be torn off or may be detached from the fringe 14 of the container opening 12. To this end, the sealing foil 26 can comprise a pull tab, for example, or the like even if this is not necessary categorically and is therefore not the case in the shown embodiment.

As indicated in FIG. 1B, form and size of the bridge 30 of the lid 16 correspond essentially to those of the fringe 14 of the container opening 12 in radial direction (right/left direction in FIGS. 1A and 1B). It is thereby achieved that the sealing foil 26 is pressed against the fringe 14 of the container opening 12 essentially evenly and completely with the lid 16 screwed on. So a better or stronger sealing connection 34 can be achieved between the sealing foil 26 and the fringe 14.

When producing the fixing connection 28 between the sealing foil 26 and the bridge 30 of the lid 16 on the one hand and the sealing connection 34 between the sealing foil 26 and the fringe 14 of the container opening 12 on the other hand, attention has to be paid that the fixing connection 28 is designed to be significantly weaker than the sealing connection 34. This can be achieved, for example, by different joining technologies, by different sizes of the connecting surfaces and/or by differences of the materials to be connected. Through this it is guaranteed that the sealing foil 26 is separated from the bridge 30 of the lid 16 at least when removing the lid 16 from the container 10 for the first time, while the sealing connection 34 is maintained between the sealing foil 26 and the fringe 14 of the container opening 12, in contrast. This causes impressions to the consumer similar to those when opening usual packagings with sealing foil on a carrier disk in the lid for the first time.

However, in contrast to usual packaging systems with a sealing foil being arranged in the lid with the help of a carrier disk (e.g., from cardboard), such a carrier disk can be omitted in the packaging according to the present invention. The sealing foil 26 is fixed directly at the lid 16 and is thereby secured against falling off or being blown out during the production process or filling process. The number of components is reduced by the omission of the carrier disk of the packaging. Further, recycling of the lid becomes simpler, because it is comprised of one component and therefore of one material, only.

The drawings in FIGS. 1A and 1B as well as in the other figures are not to scale. In particular, the sealing foil 26 is generally designed to be significantly thinner than shown with respect to the remaining components such as lid 16 and container 10.

A second embodiment of a packaging according to the present invention is explained by FIGS. 2 and 3 in the following.

Figure 2:
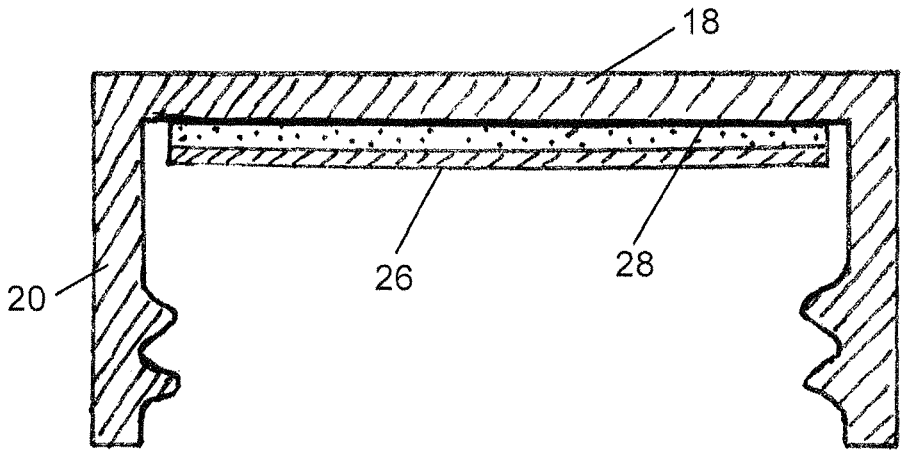
FIG. 2 shows a schematic sectional view of a lid with sealing foil according to the second embodiment of the invention.
Figure 3A:
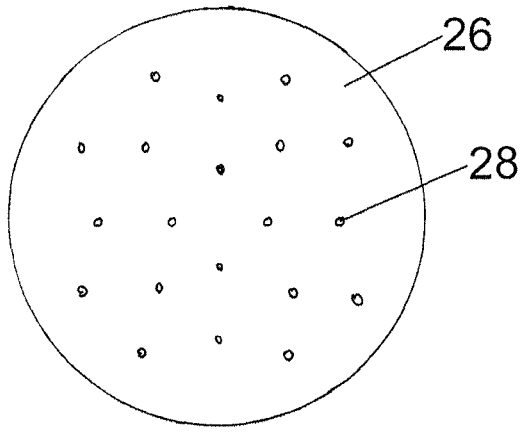
FIG. 3A to C show schematic presentations for explaining different section-wise fixing connections between the sealing foil and the lid from FIG. 2.
Figure 3B:
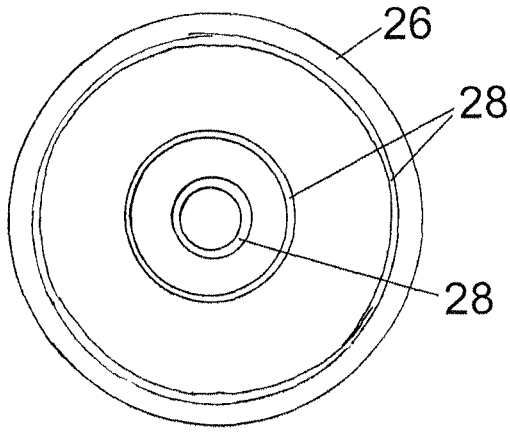
Figure 3C:
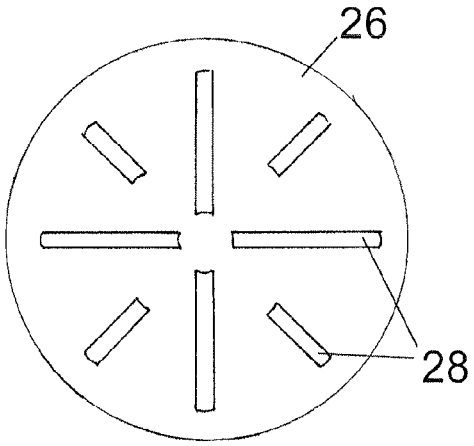

As shown in FIG. 2, the lid 16 does not comprise a bridge 30 in contrast to the first embodiment described above. Instead, the sealing foil 26 is in holohedral contact with the inside surface of the closing disk 18 of the lid 16. In this case, the fixing connection 28 between the sealing foil 26 and the lid 16 can be carried out in an essentially holohedral manner, for example.

In this case, a fixing connection 28 established only sectionally can be provided between the sealing foil 26 and the closing disk 18 of the lid, alternatively. As shown exemplarily in FIGS. 3A, 3B and 3C, this sectional fixing connection 28 can for example be achieved by point-shaped connections, ring-shaped strip connections or radial strip connections of different sizes and numbers. The person skilled in the art will be able to identify numerous other variations for sectional fixing connections without further ado.

The distance between the sealing foil 26 and the internal thread 24 of the lid 16 of the embodiment shown in FIGS. 2 and 3 is enlarged in comparison to the embodiment shown in FIGS. 1A and 1B. Therefore, the positioning of the outside thread 22 on the fringe 14 of the container opening 12 has to be adapted, accordingly. Alternatively, the position of the internal thread 24 at the lid 16 or the radial measure of the fringe section 20 of the lid 16 can be also adapted to the container 10.

Incidentally, this embodiment corresponds to the packaging shown in FIGS. 1A and 1B. Therefore another description of the other components and their advantages is omitted.

Figure 4:
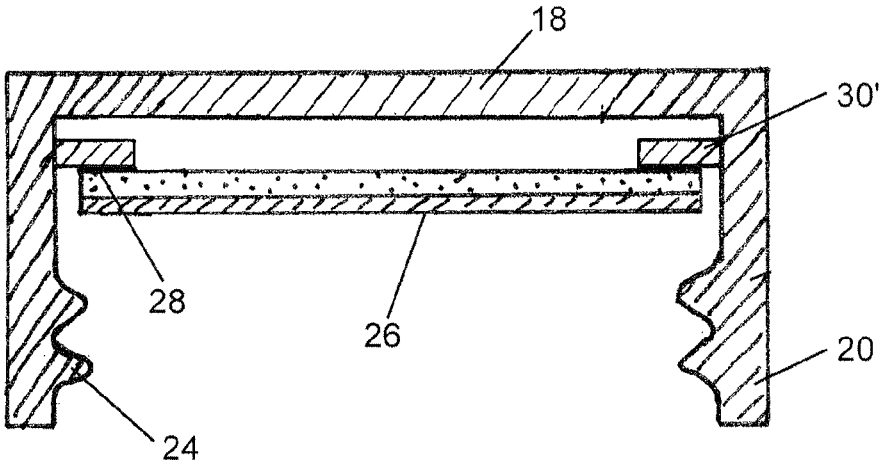
FIG. 4 shows a schematic sectional view of a lid with sealing foil according to the third embodiment of the invention.

FIG. 4 shows a third embodiment of a lid of a packaging according to the present invention.

This lid 16 according to FIG. 4 differs from that of the first embodiment according to FIGS. 1A and 1B by the design of the bridge 30'. While the bridge 30 of the lid 16 shown in FIGS. 1A and 1B projects from the closing disk 18 towards the container 10 in axial direction, the bridge 30' of this third embodiment projects from the fringe section 20 of the lid 16 essentially radially inwards.

The further components and arrangements correspond to those of the first embodiment, for example.

Figure 5:
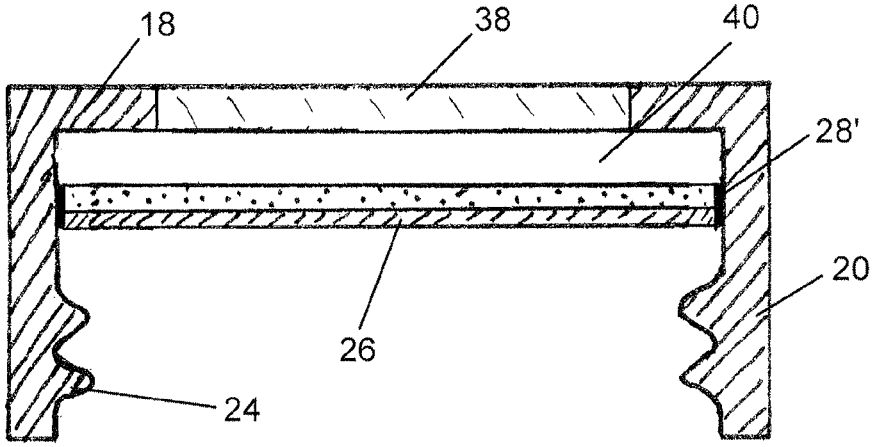
FIG. 5 shows a schematic sectional view of a lid with sealing foil according to the fourth embodiment of the invention.

In FIG. 5 a fourth embodiment of a lid of a packaging according to the present invention is shown.

This embodiment differs from the embodiments described with reference to FIGS. 1 to 4 by the sort of the fixing connection 28' between the sealing foil 26 and the lid 16. While the sealing foil 26 in FIGS. 1 to 4 is connected with the bridge 30 or the closing disk 18 of the lid 16 through its side face facing away from the container, here the sealing foil 26 is fixed via its radial circumferential surface at the fringe section 20 of the lid 16.

Further, a sight opening 38 is provided within the closing disk 18 of the lid 16 of this embodiment. This sight opening 38 is provided, for example, essentially concentric and is formed, for example, by a transparent or not pigmented plastic area within a plastic lid 16. On the side face of the sealing foil 26 facing the closing disk 18 of the lid 16, for example, a print or the like that can be provided to serve as an consumer information surface.

Further, it is possible to place smaller objects (e.g., as additional advertising arrangements) in the space 40 between the closing disk 18 of the lid 16 and the sealing foil 26 which can be seen by the user through the sight opening 38. After opening the packaging for the first time, the interior space 40 is readily accessible by the consumer because the sealing foil 26 separated from the lid 16.

The further components and arrangements correspond to those of the first embodiment.

Figure 6:
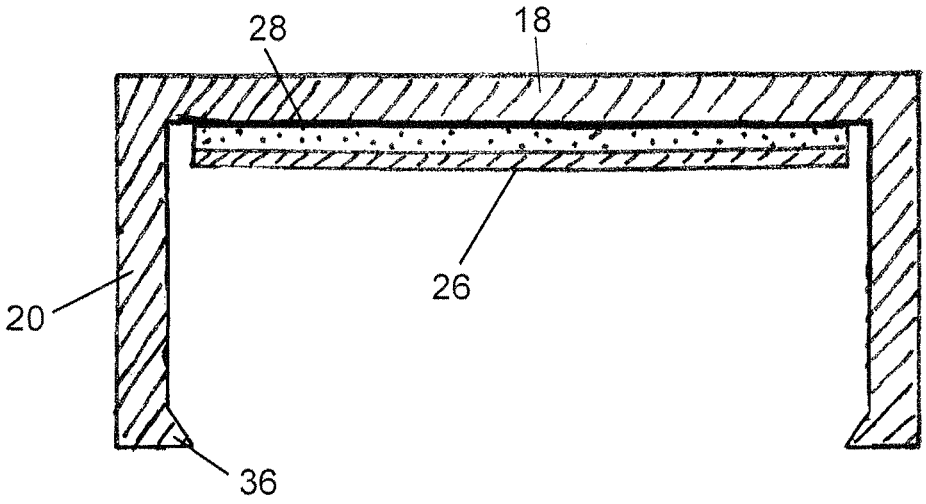
FIG. 6 shows a schematic sectional view of a lid with sealing foil according to the fifth embodiment of the invention.
Figure 7A:
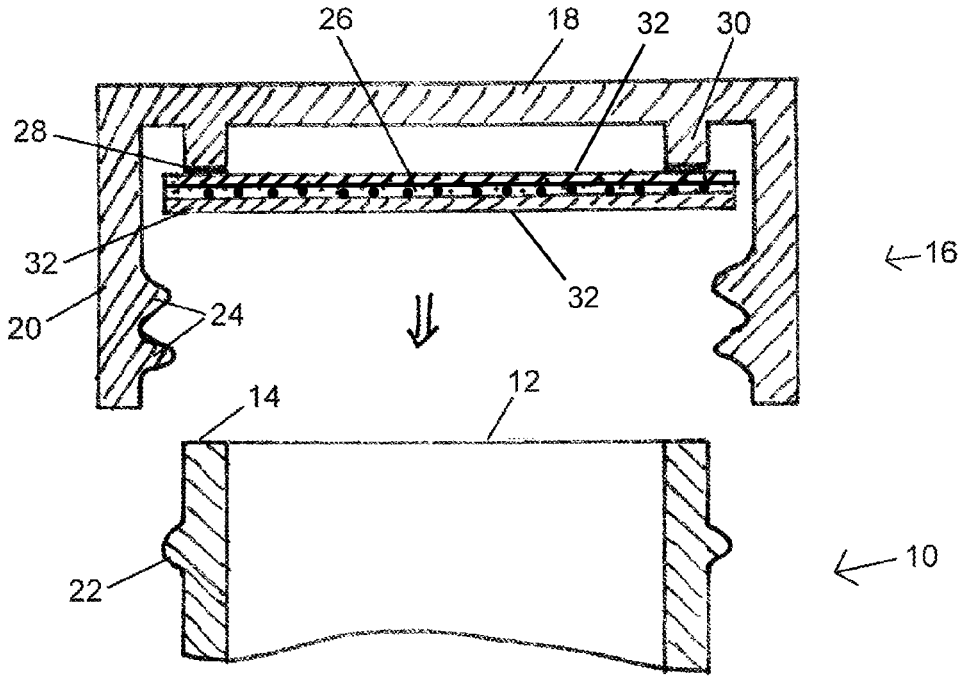
FIG. 7A shows a schematic sectional view of a packaging according to the first embodiment, wherein the sealing foil comprises a layer of plastic on both sides of the sealing foil, before sealing the container with the lid.
Figure 7B:
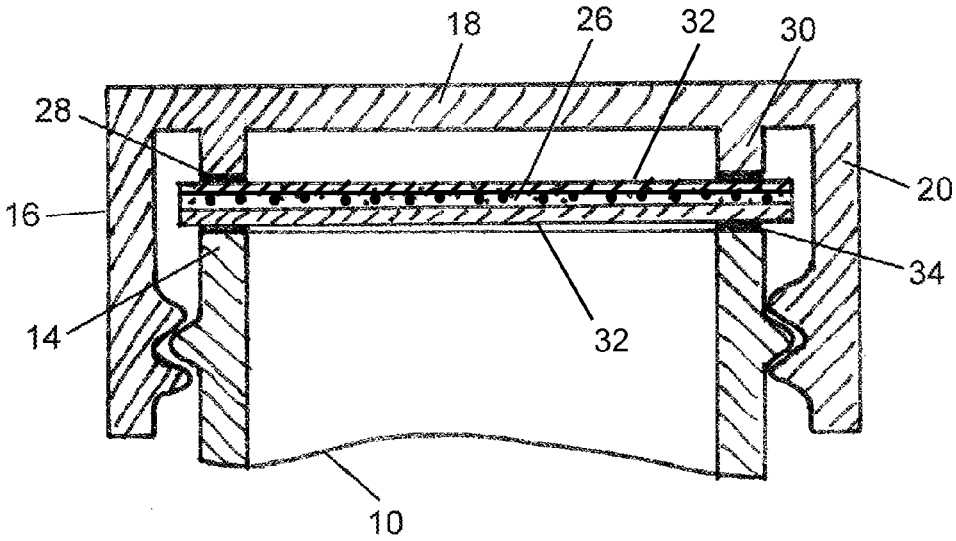
FIG. 7B shows a schematic sectional view of a packaging according to the first embodiment, wherein the sealing foil comprises a layer of plastic on both sides of the sealing foil, on sealing the container with the lid.
Figure 8:
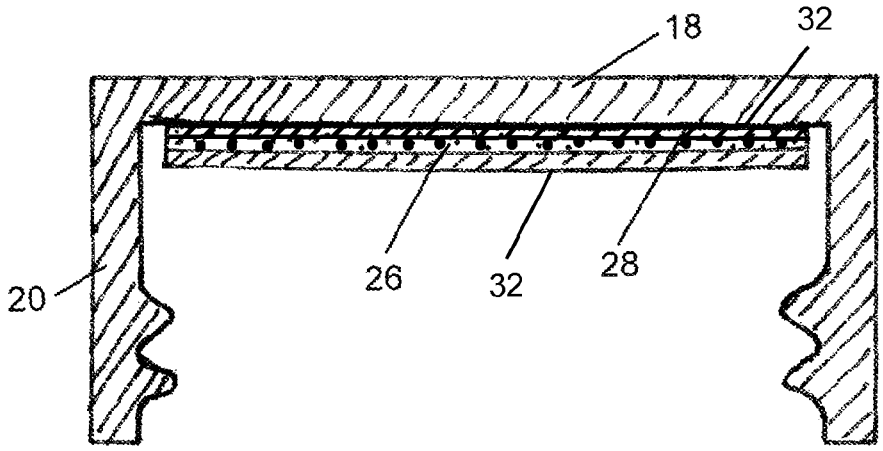
FIG. 8 shows a schematic sectional view of a lid with a sealing foil according to the second embodiment of the invention wherein the sealing foil comprises a layer of plastic on both sides of the sealing foil.
Figure 9:
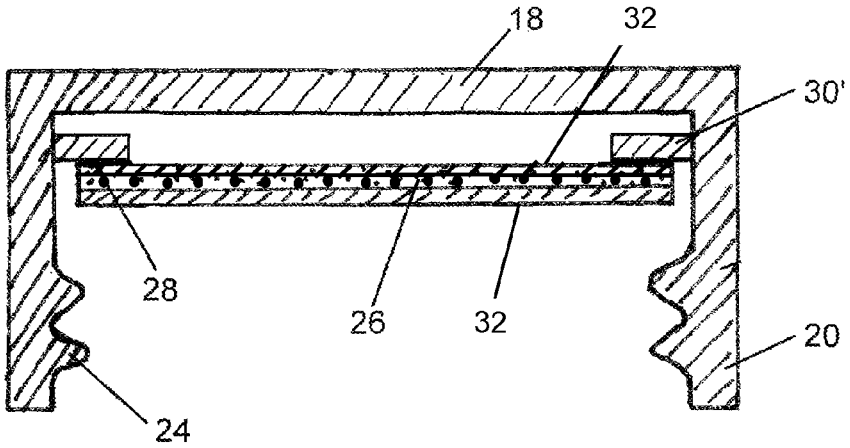
FIG. 9 shows a schematic sectional view of a lid with a sealing foil according to the third embodiment of the invention wherein the sealing foil comprises a layer of plastic on both sides of the sealing foil.
Figure 10:
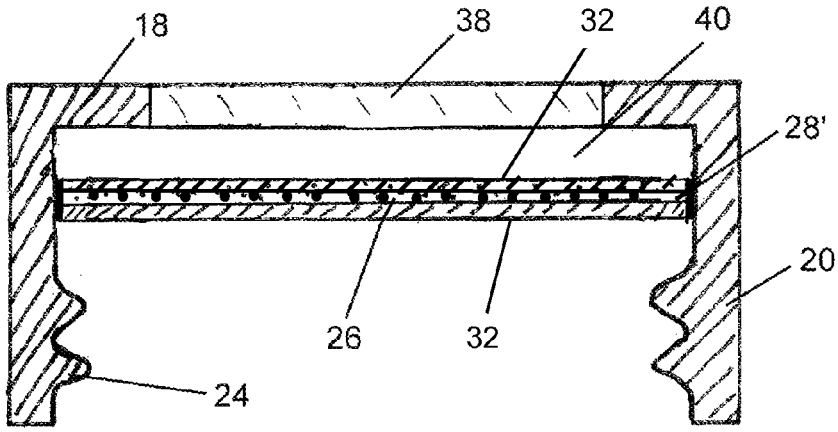
FIG. 10 shows a schematic sectional view of a lid with a sealing foil according to the fourth embodiment of the invention wherein the sealing foil comprises a layer of plastic on both sides of the sealing foil.

Referring to FIG. 6, another embodiment of a lid of a packaging according to the present invention is described.

The lid 16 of FIG. 6 differs from that of the previous embodiments by the sort of locking technology in combination with the container 10. While the lids 16 of FIGS. 1 to 5 were each formed with an internal thread 24 for screwing to an outside thread 22 of the container 10, the lid 16 of the present embodiment comprises a projection 36 at its fringe section 20 projecting radially inwardly which can snap shut in a suitable cavity or recess (not displayed) in the outside perimeter of the fringe 14 of the container opening 12.

The other components and arrangements correspond to those of the second embodiment.

Of course, the features of the embodiments described before with the help of the attached drawings can be combined with each other in any manner. Thus, for example, the spring lid from FIG. 6 can be also applied to the packagings of FIGS. 1 to 5. Also, the sight opening of the lid of the fourth embodiment can be also used with the other embodiments.

What is claimed is:

1. Closure for a container, comprising:

a lid for closing an opening of a container; and a sealing foil having a layer of plastic on one side of the sealing foil for fixation of the foil directly to an interior portion of the lid, and a layer of plastic on the other side of the foil for fixation of the foil to a fringe on an opening of a container, wherein the sealing foil is fixed directly to an interior portion of the lid by a detachable fixing connection between the plastic layer of the sealing foil and a portion of the lid, the fixing connection between the sealing foil and the lid being weaker than the intended sealing connection between the sealing foil and the fringe of the container opening.

2. Closure according to claim 1, wherein the sealing foil's radial circumferential surface is fixed to the interior portion of the lid.

3. Closure according to claim 1, wherein the sealing foil is fixed to the interior portion of the lid in an essentially holohedral manner.

4. Closure according to claim 1, wherein the sealing foil is sectionally fixed to the interior portion of the lid.

5. Closure according to claim 4, wherein the sealing foil is fixed to the interior portion of the lid through one or several connecting points, strips and/or surfaces.

6. Closure according to claim 1, wherein the lid comprises a bridge for pressing the sealing foil against the fringe on the container opening when the lid closes the container opening.

7. Closure according to claim 6, wherein the bridge corresponds essentially to the fringe of the container opening with respect to form and size of the lid in radial direction.

8. Closure according to claim 6, wherein the sealing foil is fixed to the bridge.

9. Packaging, comprising:

a container with an opening and a closure for the container;

the closure, comprising:

a lid for closing the container opening; and a sealing foil having a layer of plastic on one side of the sealing foil for fixation of the foil directly to an interior portion of the lid, and a layer of plastic on the other side of the foil for fixation of the foil to a fringe on an opening of a container, wherein the sealing foil is fixed directly to an interior portion of the lid by a detachable fixing connection and the fixing connection between the plastic layer of the sealing foil and a portion of the lid is weaker than the intended sealing connection between the sealing foil and the fringe of the container opening sealing connection, so that the sealing foil is separated from the lid at least when removing the lid from the container opening for the first time, but the sealing connection is maintained between the sealing foil and the fringe of the container opening.

10. Packaging according to claim 9, wherein the sealing foil's radial circumferential surface is fixed to the interior portion of the lid.

11. Process for sealing a container with an opening which is sealable by a lid, comprising the steps:

providing a lid;

providing a sealing foil having a layer of plastic on one side of the sealing foil for fixation of the foil directly to an interior portion of the lid, and a layer of plastic on the other side of the foil for fixation of the foil to a fringe on an opening of a container;

fixing the sealing foil directly to an interior portion of the lid by a detachable fixing connection between the plastic layer of the sealing foil and a portion of the lid;

closing the container opening with the lid; and sealing the sealing foil to a fringe of the container opening, by a fixing connection between the sealing foil and the lid is formed, wherein the fixing connection between the plastic layer of the sealing foil and a portion of the lid is weaker than the sealing connection between the sealing foil and the fringe of the container opening.

12. Process according to claim 11, wherein the sealing foil is pressed against the fringe of the container opening when closing the container opening with the lid.

13. Process according to claim 11, wherein the sealing foil's radial circumferential surface is fixed to the interior portion of the lid.

* * * * *